US010099826B2

(12) United States Patent
Testa et al.

(10) Patent No.: US 10,099,826 B2
(45) Date of Patent: Oct. 16, 2018

(54) POURER WITH RETRACTABLE SPOUT

(71) Applicant: Guala Closures S.p.A., Alessandria (IT)

(72) Inventors: Fabio Testa, Carentino (IT); Marco Giovannini, Milan (IT); Luca Viale, Alessandria (IT)

(73) Assignee: Guala Closures S.p.A. (IT)

( * ) Notice: Subject to any disclaimer, the term of this patent is extended or adjusted under 35 U.S.C. 154(b) by 32 days.

(21) Appl. No.: 14/427,190

(22) PCT Filed: Jul. 12, 2013

(86) PCT No.: PCT/IB2013/055756

§ 371 (c)(1),
(2) Date: Mar. 10, 2015

(87) PCT Pub. No.: WO2014/037825

PCT Pub. Date: Mar. 13, 2014

(65) Prior Publication Data

US 2015/0246759 A1 Sep. 3, 2015

(30) Foreign Application Priority Data

Sep. 10, 2012 (IT) ..... MI2012A1498
Sep. 10, 2012 (IT) ..... MI2012A1499

(51) Int. Cl.
*B67D 3/00* (2006.01)
*B65D 47/06* (2006.01)
*B65D 25/48* (2006.01)

(52) U.S. Cl.
CPC ..... *B65D 47/061* (2013.01); *B65D 25/48* (2013.01)

(58) Field of Classification Search
CPC ..... B65D 47/061; B65D 25/48
(Continued)

(56) References Cited

U.S. PATENT DOCUMENTS 1,327,067 A * 1/1920 Starcke ..... B65D 25/44 222/525
1,328,881 A * 1/1920 Lazarus ..... B65D 47/061 222/514

(Continued)

FOREIGN PATENT DOCUMENTS

DE 1482576 4/1969
DE 1482530 7/1969

(Continued)

*Primary Examiner* — Patrick M Buechner
*Assistant Examiner* — Michael J Melaragno
(74) *Attorney, Agent, or Firm* — Alan G. Towner; Leech Tishman Fuscaldo & Lampl

(57) ABSTRACT

The present invention relates to a pourer comprising a tubular body which is able to be attached to a container and a pouring spout accommodated within the tubular body and reversibly movable relative to the tubular body between a retracted position and an extracted position. The pouring spout has a pouring lip conformed to define a pouring orientation and the tubular body and the pouring spout are coupled together by coupling means that are able to guide the movement of the pouring spout relative to the tubular body between the retracted and extracted positions and prevent rotation of the pouring spout relative to the tubular body to hold the relative angular position of the pouring lip with respect to the tubular body.

15 Claims, 10 Drawing Sheets

Figure 1:
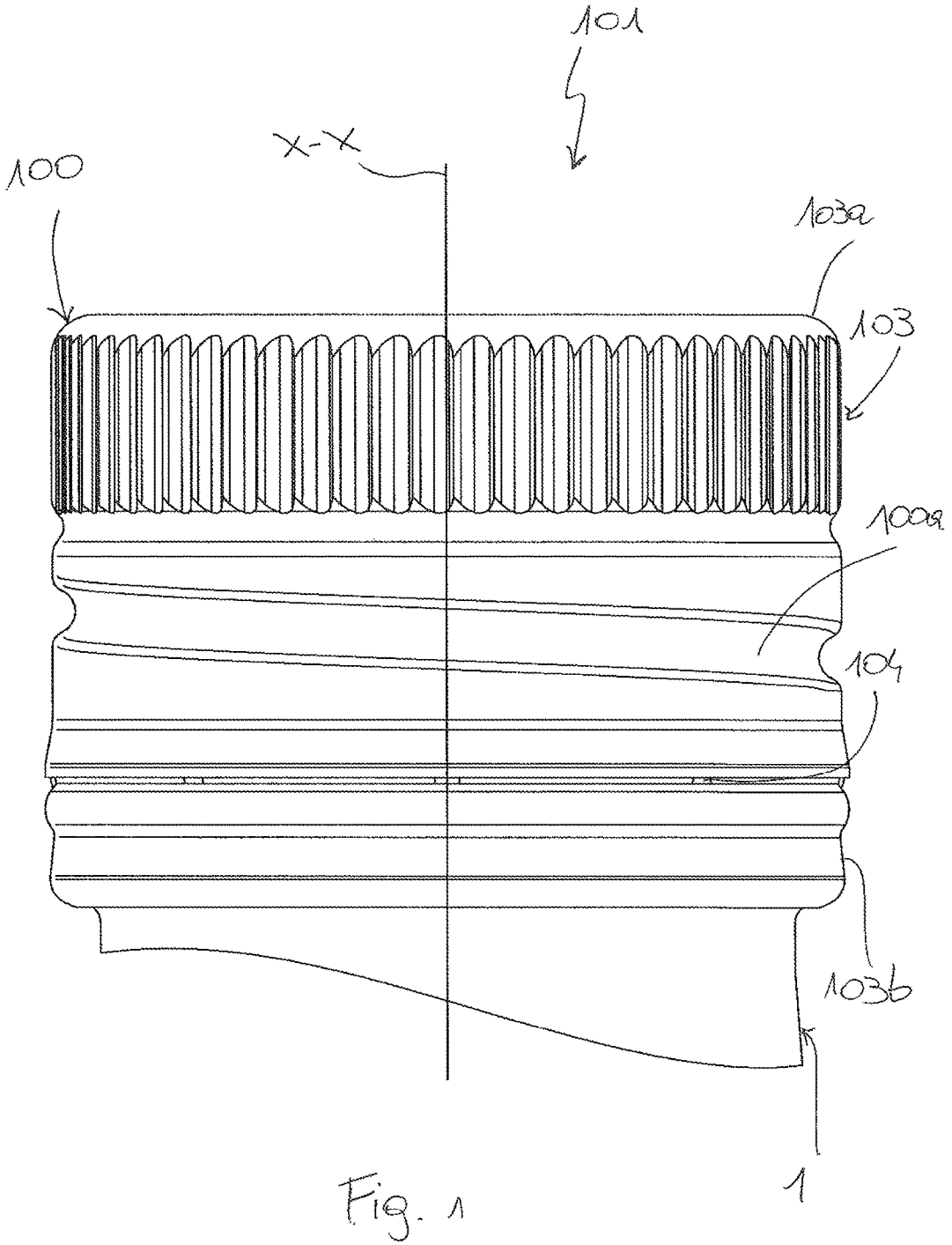

(58) Field of Classification Search
USPC ..... 222/538
See application file for complete search history.

(56) References Cited

U.S. PATENT DOCUMENTS

| | | | | | |
|---|---|---|---|---|---|
| 1,473,925 | A * | 11/1923 | Dryer | B65D 47/061 | 193/30 |
| 1,750,205 | A * | 3/1930 | Willumsen | B60K 15/06 | 222/514 |
| 2,010,048 | A * | 8/1935 | Young | B65D 47/061 | 222/488 |
| 2,300,440 | A * | 11/1942 | Vaughn | B65D 47/061 | 222/488 |
| 2,344,505 | A * | 3/1944 | Eckman | B65D 47/061 | 222/539 |
| 2,545,178 | A * | 3/1951 | Vaughn | B65D 47/061 | 206/508 |
| 2,695,736 | A * | 11/1954 | Punte | B65D 47/061 | 222/489 |
| 2,706,069 | A * | 4/1955 | Rasmussen | B65D 25/42 | 222/538 |
| 2,773,632 | A * | 12/1956 | Dobbins | B65D 47/061 | 222/525 |
| 2,774,523 | A * | 12/1956 | Rieke | B65D 47/061 | 222/499 |
| 2,840,280 | A * | 6/1958 | Bee | B65D 47/061 | 222/478 |
| 3,132,776 | A * | 5/1964 | Wasserberg | B65D 47/061 | 220/708 |
| 3,173,587 | A * | 3/1965 | Stearns | B65D 47/061 | 222/479 |
| 3,235,146 | A * | 2/1966 | Parish, Jr. | B65D 25/44 | 222/478 |
| 3,310,206 | A * | 3/1967 | Littlefield | B65D 47/061 | 222/525 |
| 3,372,846 | A * | 3/1968 | Berkus | B65D 25/44 | 222/479 |
| 3,434,637 | A * | 3/1969 | Henri | B65D 47/127 | 222/570 |
| 3,658,218 | A * | 4/1972 | Krautkramer | B65D 47/141 | 222/522 |
| 3,717,289 | A * | 2/1973 | Laurizio | B65D 47/061 | 222/481 |
| 3,752,369 | A * | 8/1973 | Robert | B65D 47/061 | 222/481 |
| 3,834,597 | A * | 9/1974 | Guala | B65D 47/103 | 222/153.02 |
| 3,934,760 | A * | 1/1976 | Le Gresley | B67D 3/046 | 222/478 |
| 4,022,357 | A * | 5/1977 | Dwinell | B65D 47/061 | 222/537 |
| 4,076,151 | A * | 2/1978 | Littlefield | B65D 47/121 | 222/153.07 |
| 4,311,259 | A * | 1/1982 | Babiol | B65D 25/44 | 220/285 |
| 4,320,861 | A * | 3/1982 | Rieke | B65D 55/0863 | 215/249 |
| 4,650,096 | A * | 3/1987 | Thatcher | B65D 47/061 | 222/153.06 |
| 4,726,491 | A * | 2/1988 | Moon | B65D 25/44 | 222/1 |
| 4,971,230 | A * | 11/1990 | Clubb | B65D 25/44 | 222/468 |
| 5,107,909 | A * | 4/1992 | Donovan | B67D 7/005 | 141/198 |
| 5,197,634 | A * | 3/1993 | Beck | B65D 47/246 | 222/109 |
| 5,388,712 | A * | 2/1995 | Brody | B65D 47/14 | 215/229 |
| 5,908,256 | A * | 6/1999 | Bernstein | A45D 34/04 | 401/136 |
| 6,026,994 | A * | 2/2000 | Rigel | B65D 47/061 | 222/478 |
| 6,131,775 | A * | 10/2000 | Brody | B65D 47/061 | 215/274 |
| 9,452,919 | B2 * | 9/2016 | Dal Toso | B67B 3/262 | |
| 2005/0006418 | A1 * | 1/2005 | Rigel | B65D 47/061 | 222/481.5 |
| 2011/0084090 | A1 * | 4/2011 | MacDougall | B65D 25/44 | 222/1 |
| 2011/0266251 | A1 * | 11/2011 | Rigel | B65D 51/18 | 215/386 |
| 2013/0068799 | A1 * | 3/2013 | Rigel | B65D 41/0414 | 222/481 |
| 2013/0074448 | A1 * | 3/2013 | Dal Toso | B65D 23/14 | 53/367 |

FOREIGN PATENT DOCUMENTS

| | | | | |
|---|---|---|---|---|
| DE | 8603167 | U1 | 6/1986 | |
| EP | 1831082 | B1 | 8/2009 | |
| EP | 2371730 | A1 | 10/2011 | |
| FR | 1375655 | A | 10/1964 | |
| FR | 2799739 | A1 | 4/2001 | |
| GB | 142862 | A | 7/1921 | |
| WO | 2006087740 | A1 | 8/2006 | |
| WO | WO 2006087740 | A1 * | 8/2006 | B65D 47/283 |

* cited by examiner

POURER WITH RETRACTABLE SPOUT

The present invention concerns a pourer with a retractable spout.

Pourers with retractable spouts are known in the art, for instance, from EP 2 371 730, EP 1 831 082, FR 2 799 739, U.S. Pat. No. 6,026,994.

EP 2371739 discloses a pouring cap comprising an upper closing member and a lower element able to be attached to a bottle neck. The cap comprises a tubular ring downwardly projecting from the upper wall of the cap and having an external protuberance. The lower element is equipped with a retractable spout and with means for attaching the upper end of the spout to the protuberance of the tubular ring of the cap. At the upper end, the pouring spout has an annular lip. The lower element also comprises a duct for the entry of air which allows communication between the inside and the outside of the container.

EP 1831082 discloses a pourer that comprises an insert designed to be fixed to a bottle and defining a liquid passage, a pouring spout configured to project from the insert and a closing cap. The insert also comprises a passage for air. The cap comprises wings which are able to engage with the pouring spout for extraction thereof upon cap removal.

FR 2799739 discloses a pourer that comprises a body having means for fixation to a container neck; a center tube that can axially move relative to the body and connecting means for connection of the body with the center tube, as well as means for displacing the center tube relative to the body. In one embodiment, the pourer has an oblique opening for the passage of air, which is formed in a common lower base of the center tube and the body.

The above mentioned technical solutions have a common drawback: they do not allow a user to easily confirm proper pouring orientation of the container with the pourer mounted thereto, whereby pouring effectiveness of pourers will depend on the random orientation of the container when a user takes hold of it. Here, the passage for air may not be in the desired position, i.e. ideally opposite to the area through which the liquid flows out of the container. Of course, user guiding systems may be provided, but this will affect pourer mounting flexibility, as well as the general cost-effectiveness of the container.

A solution to this drawback was provided in U.S. Pat. No. 6,026,994. This document discloses a pourer that comprises a sleeve designed to be fixed to a bottle neck, a pouring spout that is movable relative to the sleeve between an extended position and a retracted position and elastic members operating on the pouring spout to hold it in the extended position and able to be compressed to allow the spout to move toward the retracted position. The spout also comprises a conduit for the passage of air which is placed opposite to a reference cut formed on the upper end of the spout. While this pourer partially solves the above mentioned technical problem, it reduces the liquid passage channel defined by the spout, because part of it is used as an air passage channel.

Further pourers with retractable spouts are disclosed, for instance, by GB 142862, DE 8603167U FR 1375655, US 2011/266251, DE 1482530, DE 1482576 and U.S. Pat. No. 1,473,925.

GB 142862 discloses a pourer with a retractable spout having a pin that engages a slot formed in a sleeve for guiding and maintaining the angular orientation of the spout relative to the sleeve. Nevertheless, the spout has no element for determining a pouring orientation of the pourer. Furthermore, liquid is forced to flow through the slot, the latter fulfilling both purposes of providing an opening for the passage of liquid, and acting as a guide element. Due to this dual purpose, the slot provides a reduced and inadequate opening for the passage of liquid.

DE 8603167 discloses a pourer with a retractable spout having a lip that has such a shape as to define an orientation of the pourer. The spout is coupled to the pourer body via guiding and rotation-preventing members. Nevertheless, with this pourer, during pouring, the first part of liquid flowing from the container forms an uncontrolled jet that may be directed where the user does not want to pour the product.

In the light of the background art as discussed above, the need arises for a pourer that can indicate the right orientation for effective pouring to the user, while slowing down the liquid that flows from the container toward the pouring orifice of the retractable spout.

In view of the above discussed prior art, the object of the present invention is to fulfill the above need, while obviating prior art drawbacks.

According to the present invention, this object is fulfilled by a pourer as defined in claim 1.

Figure 2:
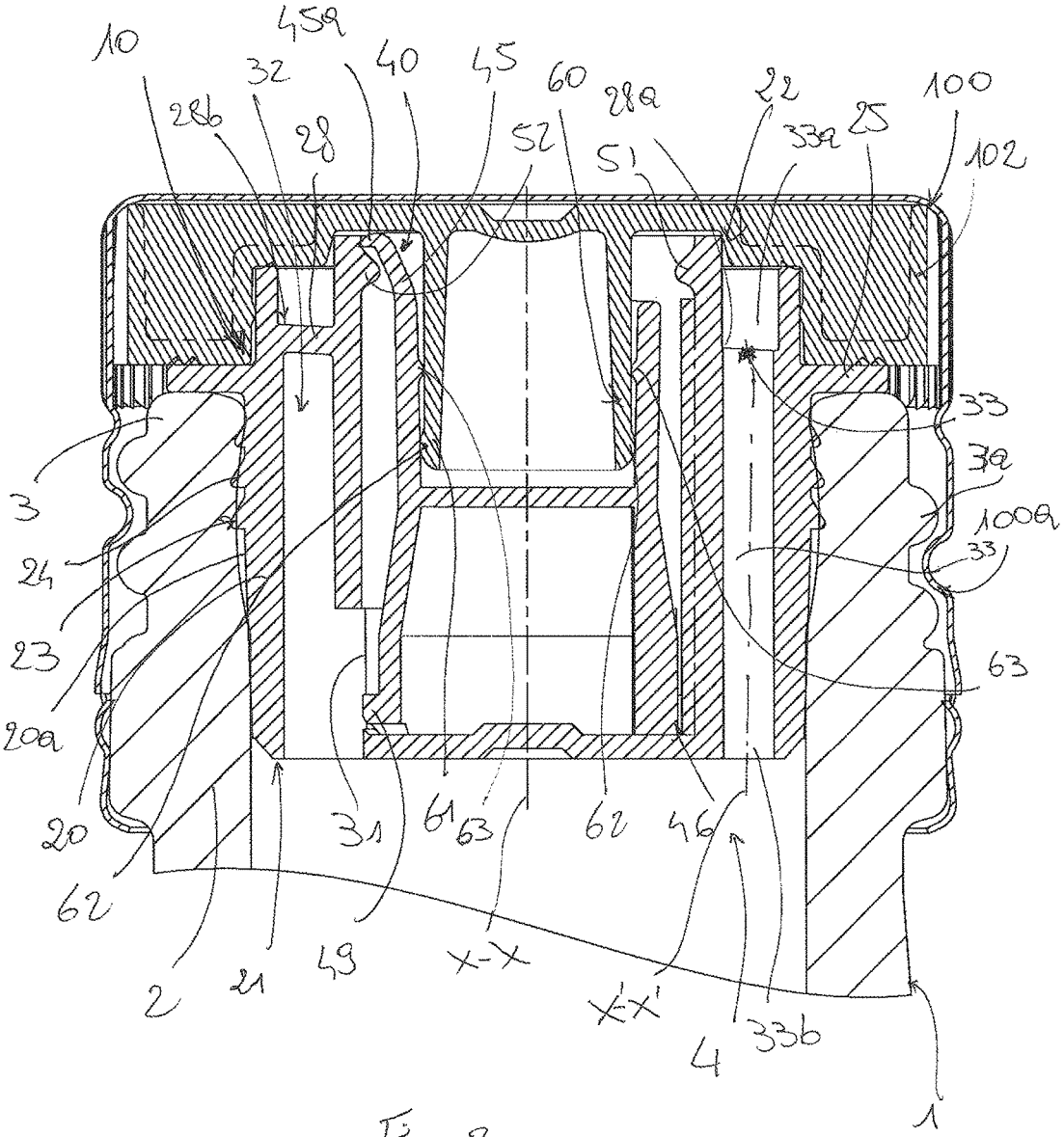
Figure 3:
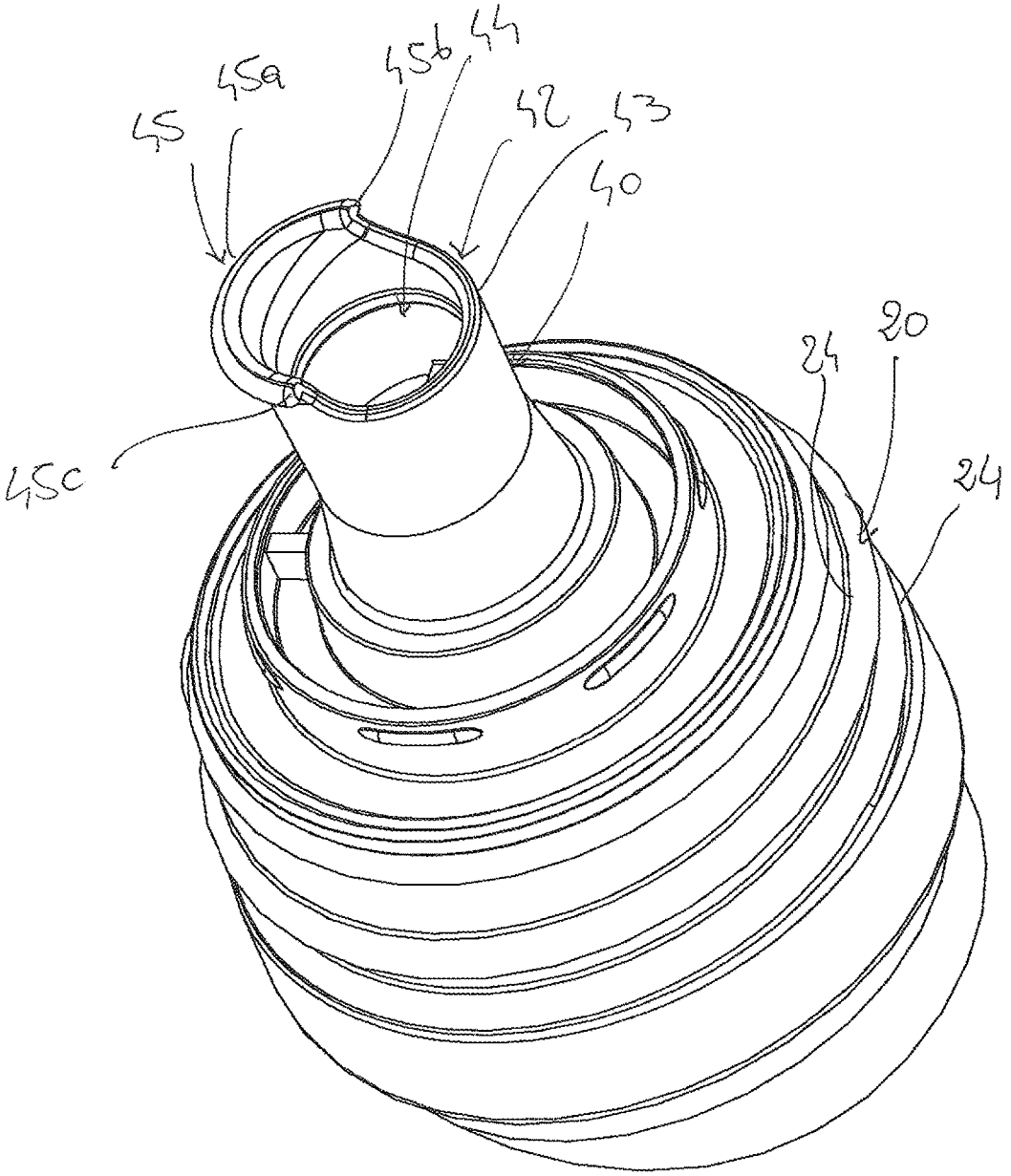
Figure 4:
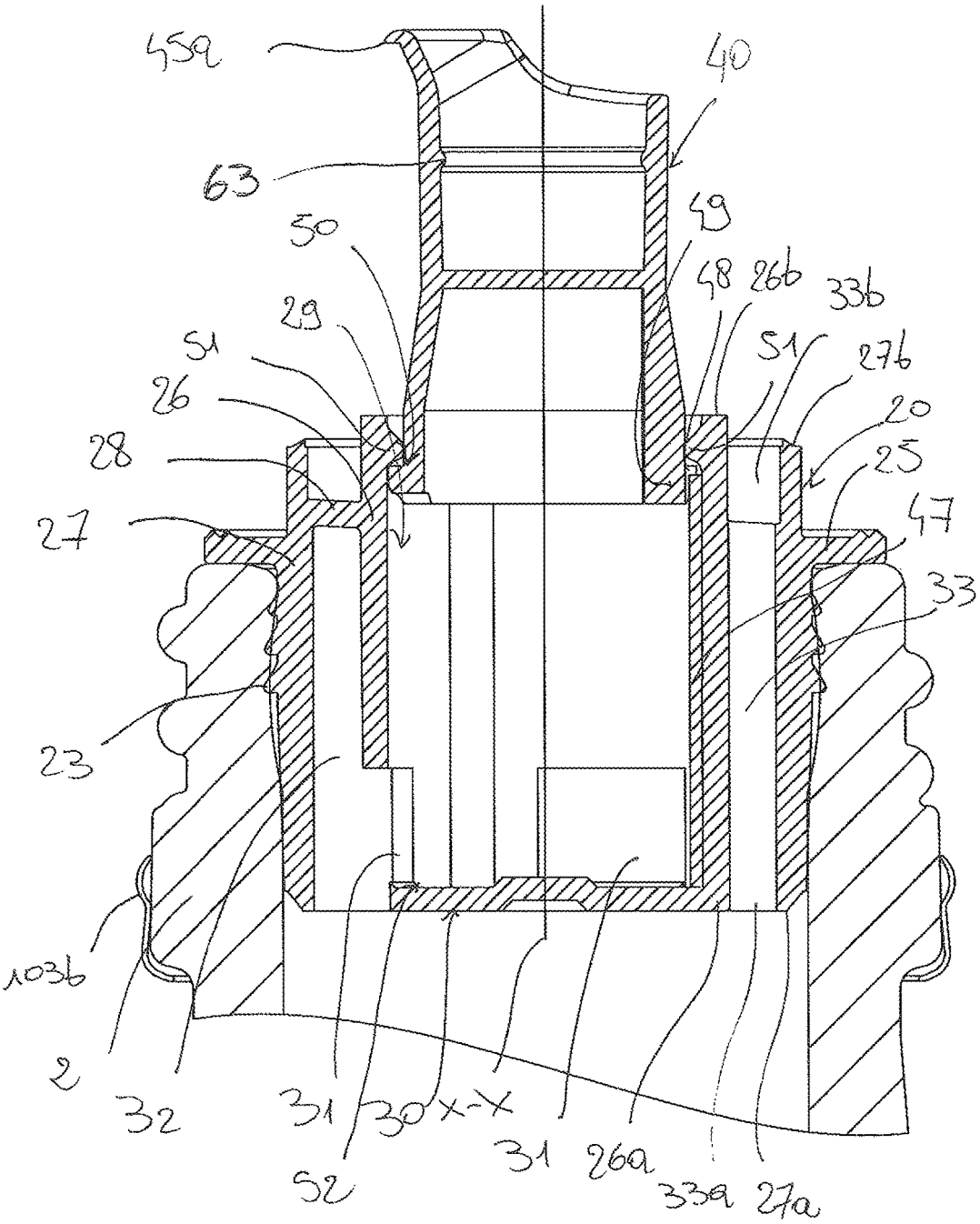
Figure 5:
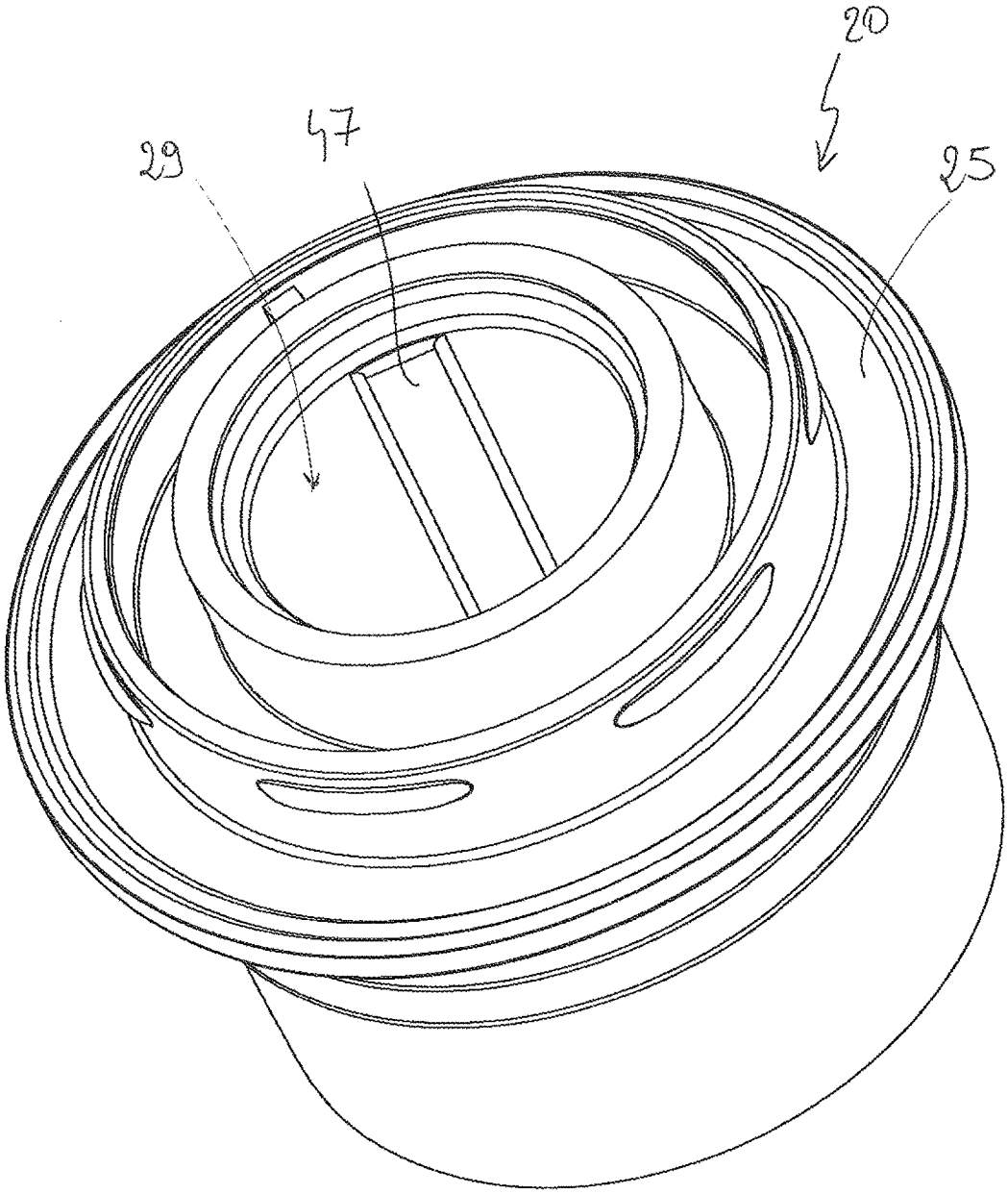
Figure 6:
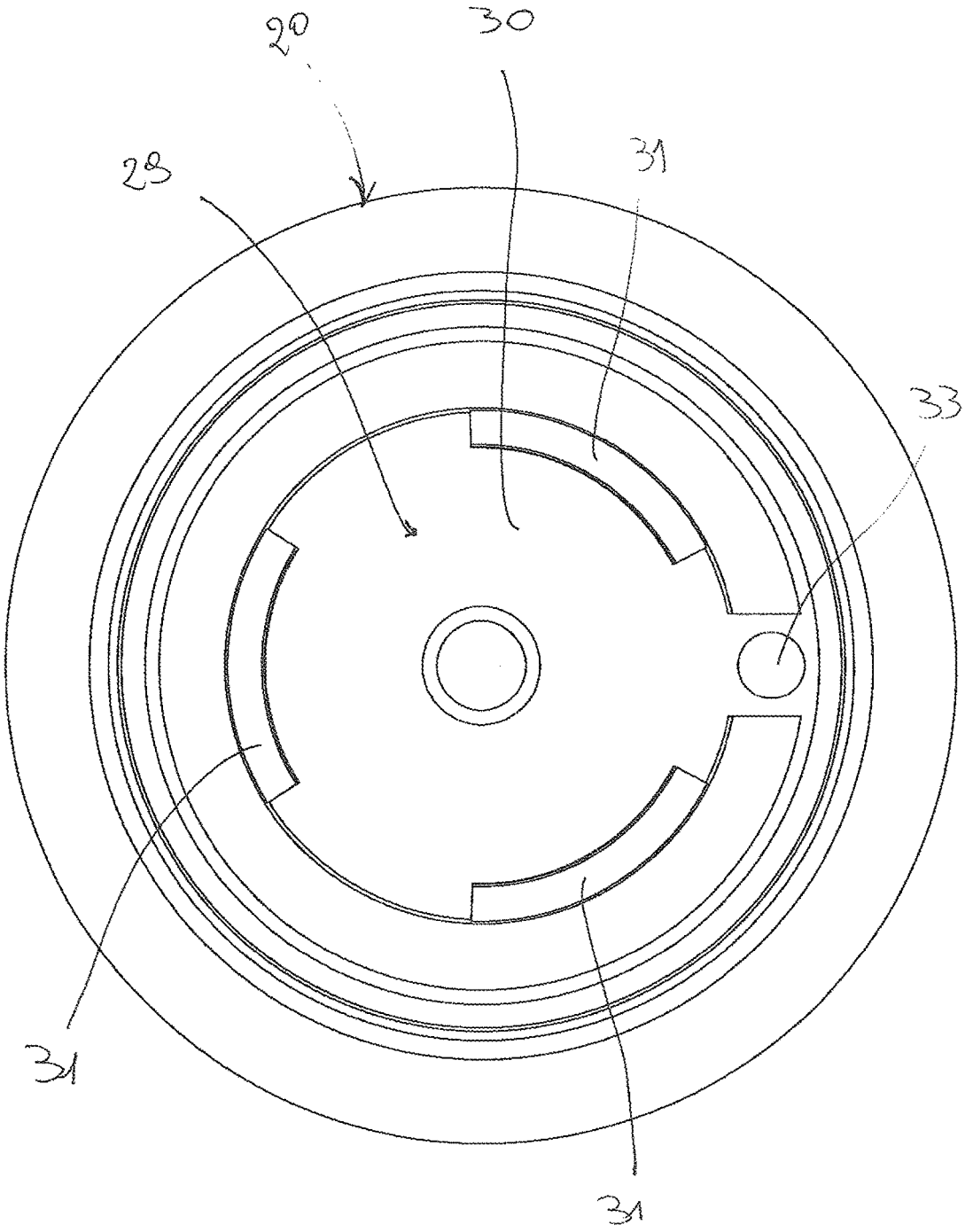
Figure 7:
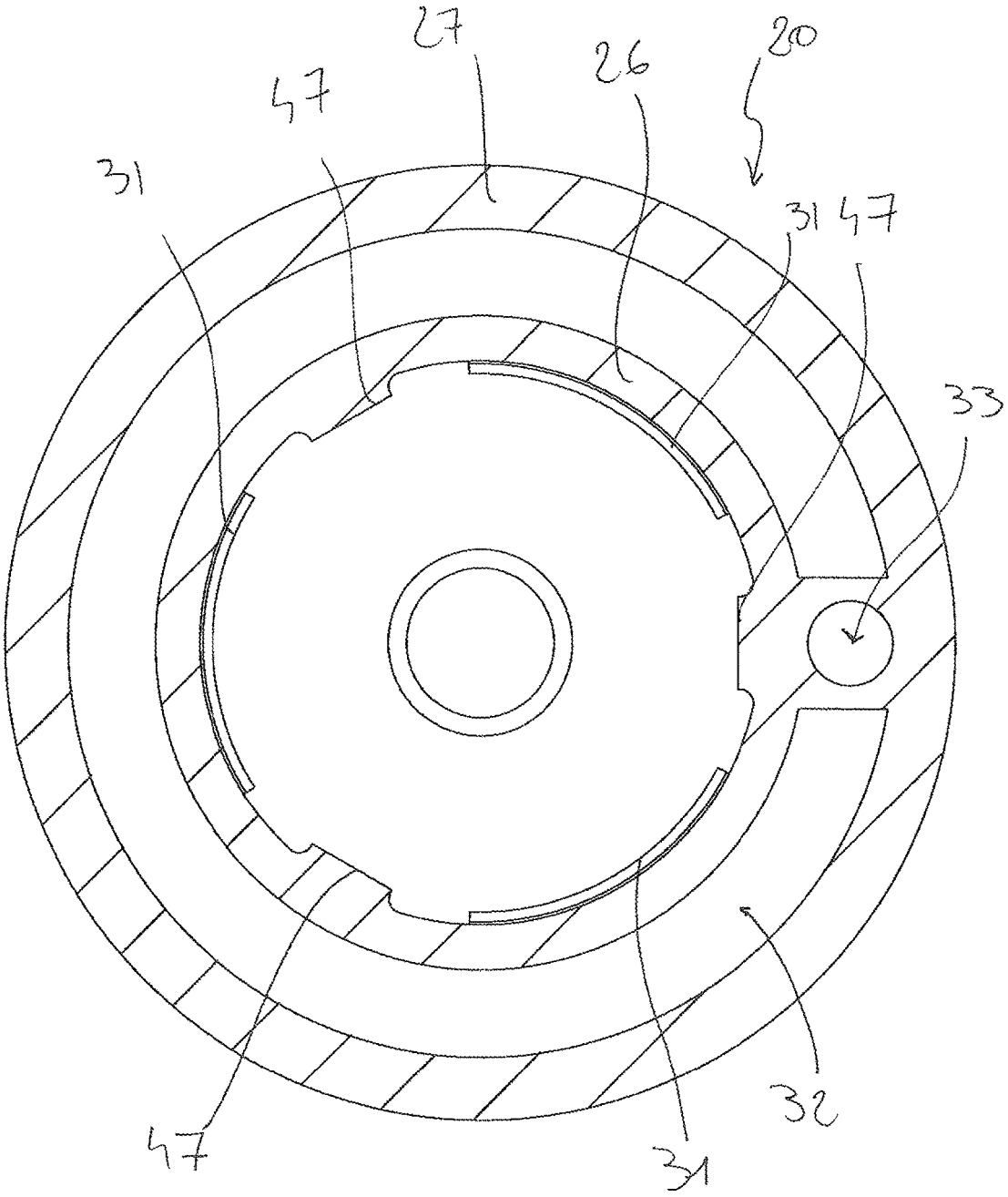
Figure 8:
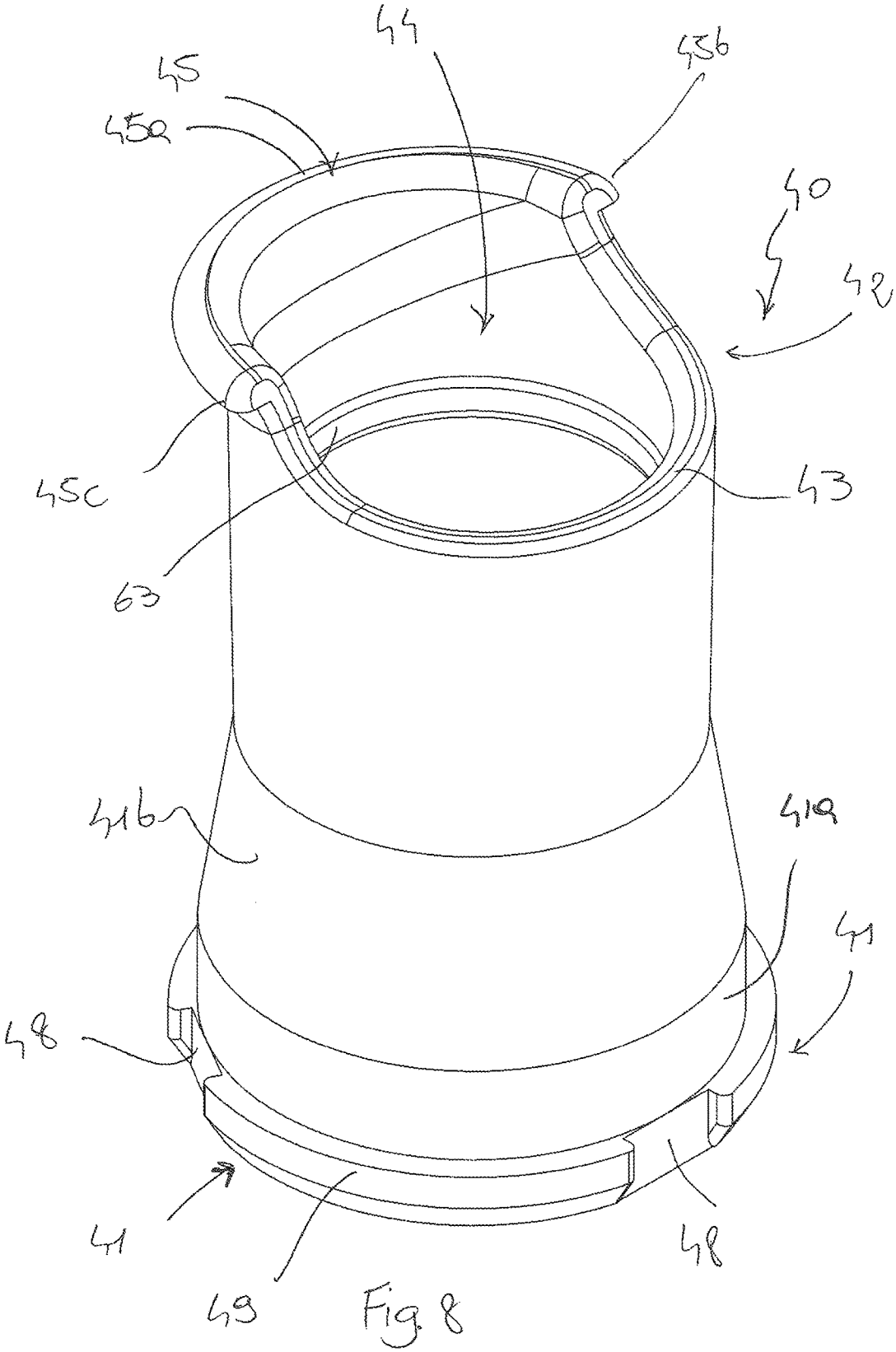
Figure 9:
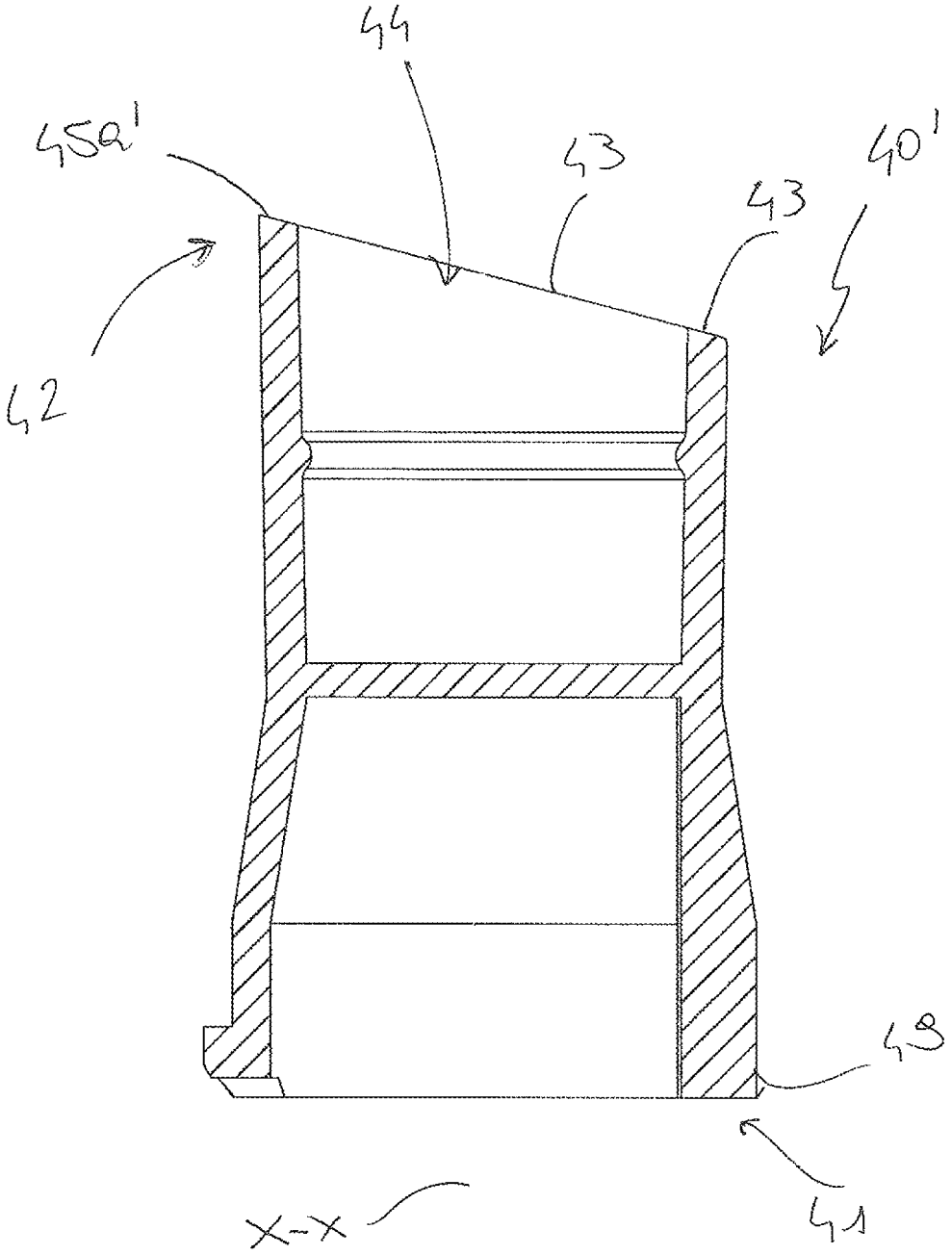
Figure 10:
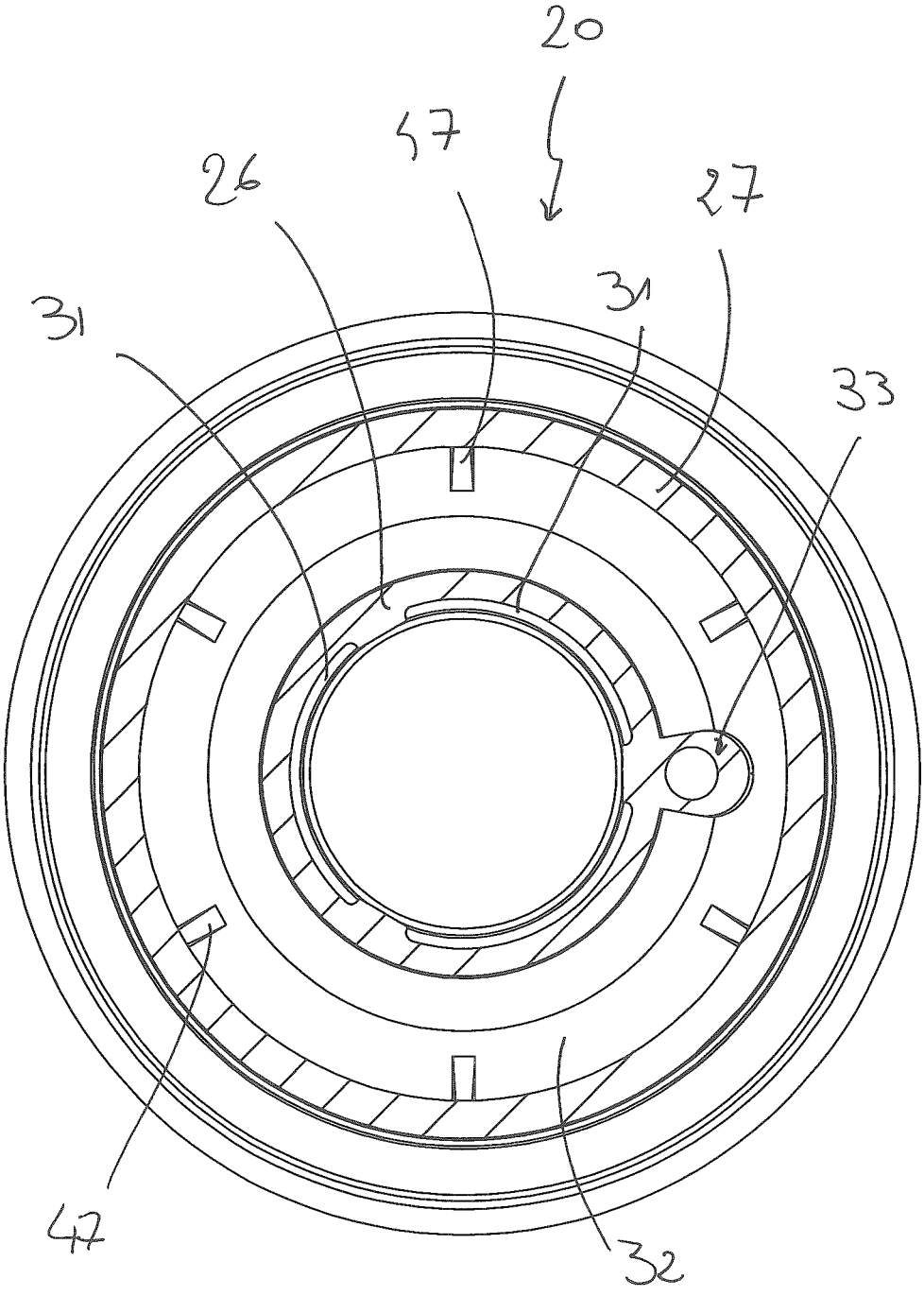

The characteristics and advantages of the present invention will appear from the following detailed description of one practical embodiment, which is illustrated without limitation in the annexed drawings, in which:

FIG. 1 shows a side view of a cap mounted to the neck of a container, that has the pourer of the present invention fixed thereto, FIG. 2 shows a sectional view of FIG. 1, with the spout in a retracted position, FIG. 3 shows a perspective view of the pourer as assembled with the container with the spout in an extracted position, FIG. 4 shows a sectional view of FIG. 3, FIG. 5 shows a perspective view of the tubular body of the pourer, FIG. 6 shows a top plan view of the tubular body of FIG. 5, FIG. 7 shows a sectional view of the tubular body of FIG. 5, FIG. 8 shows a perspective view of the tubular body of the pouring spout, FIG. 9 shows a perspective view of an alternative embodiment of a spout for the pourer of the present invention, FIG. 10 shows a sectional view of an alternative embodiment of a tubular body for the pourer of the present invention.

Although this is not expressly shown, the individual features described with reference to each embodiment shall be intended as auxiliary and/or interchangeable with other features, as described with reference to other embodiments.

Referring to the annexed figures, numeral 10 generally designates a pourer according to an embodiment of the present invention.

The pourer 10 is designed to be fitted to a container 1, such as an oil bottle and to be closed by a cap 100. The assembly composed of the pourer 10 and the cap 100 is generally referenced 101.

In the example of the figures, the container 1 is a bottle and comprises a neck 2 that terminates in a mouth 3 defining an orifice 4. The neck 3 has threads 3*a* designed for engagement of threads 100*a* of the cap 100.

Thus, the pourer 10 is designed to be fitted to the mouth 3 of the container 1.

While the pourer 10 in itself may be oriented in any direction, for the purposes of the present direction the vertical axis will be defined as the longitudinal axis X-X of the pourer 10 and conventionally the bottom side will be the side of the pourer 10 designed to face the container 1, and the top side will be the one designed to face the consumer; this is actually the normal orientation of the pourer 10 when fitted to a normally oriented bottle.

Likewise, the liquid flowing out of the pourer 10 will be conventionally directed from the side designed to face the container 1 to the side designed to face the consumer.

The pourer 10 comprises a tubular body 20 and a pouring spout 40.

The tubular body 20 extends along the longitudinal direction X-X between a lower portion 21 and an upper portion 22.

The pourer 10 is able to be attached to the container 1 and, for this purpose, the tubular body 20 comprises attachment members 23 for attaching the tubular body 20 to the neck 2 of the container 1. In this example, the tubular body 20 is coupled to the neck 2 by an "in-bore" arrangement. Alternatively, other arrangements may be provided for the connection of the tubular body 20 to the neck 2.

According to an embodiment, the attachment members 23 comprise a plurality of annular wings 24, which are longitudinally spaced over the outer surface 20*a* of the tubular body 20.

The tubular body 20 also has a flange 25, extending transverse to the longitudinal direction X-X and able to abut against the upper end of the neck 2 of the container 1, when the pourer 10 is fitted to the container 1.

According to one embodiment, the tubular body 20 comprises an inner sleeve 26, an outer sleeve 27 and a connecting flange 28 for connecting the inner and outer sleeves 26, 27. A C channel 32 is defined between the outer surface of the inner sleeve 26 and the inner surface of the outer sleeve 27. In this embodiment, the attachment members 23 and the flange 25 are formed on the outer sleeve 27. The inner sleeve 26 delimits inside a tubular cavity 29 whose purpose is described hereinafter.

The inner sleeve 26 extends longitudinally between a lower portion 26*a* and an outer portion 26*b* and the outer sleeve 27 extends longitudinally between a lower portion 27*a* and an upper portion 27*b*.

At the lower portion 21, the tubular body 20 comprises a wall 30 that extends on a plane substantially perpendicular to the longitudinal direction X-X to intercept the liquid flowing from the container 1 to the upper portion 22 of the tubular body 20. This wall 20 acts as a breakwater for the liquid that flows from the container 1 to the upper portion 22 and prevents the first part of liquid from the container to form an uncontrolled jet, upon pouring, and from flowing to areas in which the user does not want to pour the product.

According to one embodiment, the wall 20 is placed at the lower portion 26*a* of the inner sleeve 26. Particularly, the inner sleeve 26 is closed at its bottom by the wall 30.

At the lower portion 2, the tubular body 20 has at least one liquid passage opening 31 formed on the side of the tubular body 20, particularly on the side of the inner sleeve 26, above the wall 30, to allow the flow of liquid to the upper portion 22 of the tubular body 20. Advantageously, the at least one liquid passage opening 31 comprises a plurality of liquid passage openings 31 in angularly spaced arrangement.

Alternatively, the tubular body 20 may comprise a single sleeve. In the case of an "in-bore" fitting of the sleeve, the lower portion of such sleeve will taper toward the axis X-X of the pourer 10 o have a smaller diameter than the interior of the neck 2 of the container 1 near the mouth 3 to allow the liquid to flow from the interior of the container through the liquid passage openings 31.

Reference will be made hereinafter, without limitation, to a plurality of liquid passage openings 31.

In this example, the liquid passage openings 31 are formed in the lower portion 26*a* of the inner sleeve 26, immediately adjacent to the wall 30. The openings 31 are designed to allow fluid communication between the interior of the container 1 and the tubular cavity 29. During the pouring operation, the liquid that flows from the container 1 to the upper portion 22 is slowed down by the wall 30 and is forced to flow through the liquid passage openings 31 to reach the upper portion 22 of the tubular body 20.

According to one embodiment, the tubular body 20 has a passage conduit 33 for allowing fluid communication between the inside and the outside of the container 1. According to one embodiment, the passage conduit 33 is associated with the tubular body 20, here to both inner and outer sleeves 26, 27 and extends longitudinally, with the longitudinal axis X'-X' parallel to the longitudinal axis X-X, between a lower opening 33*a*, here substantially level with the lower portion 21, particularly level with the wall 30, and an upper opening 33*b*, here formed in the connecting flange 28. In this example, the passage conduit 33 is placed between the inner sleeve 26 and the outer sleeve 27 and breaks the continuity of the C channel 32.

During the pouring operation, this passage conduit 33 defines an air passage conduit from the outside to the inside of the container 1, to allow constant pouring of the liquid from the container 1. In the embodiment of the figures, the connecting flange 28 is inclined, here at about 3°, relative to a plane perpendicular to the longitudinal axis X-X of the pourer 10, to define a lower area 28*a* and an upper area 28*b*. In order to allow recovery of any liquid leaking or falling from the pouring spout 40 upon pouring, the upper opening 33*b* of the passage conduit 33 is placed at the lower area 28*a* of the flange 28.

In the embodiment of FIGS. 1 to 8, the passage conduit 33 is attached to the inner sleeve 26 and the outer sleeve 27, and is particularly formed of one piece with the inner and outer sleeves 26, 27.

FIG. 9 shows an alternative embodiment in which the passage conduit 33 is attached to the inner sleeve 26 and is separate from the outer sleeve 27. Particularly, the passage conduit 33 is radially spaced from the outer sleeve 27 at a distance d. Here, the distance d is longitudinally constant, although this distance might change, for construction requirements, in a range from a minimum value to a maximum value. In this embodiment, the passage conduit 33 is prevented from being compressed between the walls of the two sleeves 26, 27, when the pourer 10 is fitted to the neck of a container. In certain cases, the construction tolerances of the neck of the container might cause compression on the outer sleeve 27, that would directly affect the passage conduit 33.

Alternatively to the configuration of FIG. 9, the passage conduit 33 may be arranged to be attached to the outer sleeve 27, such that the passage conduit 33 may be at a distance d from the inner sleeve 26.

The pouring spout 40 is accommodated within the tubular body 20 and is movable to reversibly slide relative to the tubular body 20, in the example of the tubular cavity 29 of the inner sleeve 26, along the longitudinal direction X-X, between a retracted position, in which the pourer 10 is designed to be closed by the cap 100 and an extracted position, in which the pourer 10 is designed to pour the liquid contained in the container 1 through the pouring spout 40.

The pouring spout 40 extends along the longitudinal direction X-X between a lower portion 41 and an upper portion 42.

The pouring spout 40 has a pouring rim 45, which is conformed to define a pouring orientation of the pourer 10.

In one embodiment, the pouring rim 45 extends angularly between two ends 45*b*, 45*c* along a circumferential portion of the pouring spout 40. Particularly, the pouring rim 45 extends between the two ends 45*b*, 45*c* to deine the correct pouring position of the pourer 10.

According to one embodiment and as shown in Figures from 1 to 8, the pouring rim 45 projects radially to form a pouring lip. Thus, the pouring spout 40, and hence the pourer 10, is also effective in pouring high-viscosity liquids.

FIG. 9 shows by way of example and without limitation a pouring spout 40 with a beveled pouring rim 45', as disclosed in U.S. Pat. No. 6,026,994.

Reference will be made hereinafter, without limitation, to the pouring rim 45.

In the example of the figures, the pouring spout 40 has an annular edge 43 at its upper portion 42, that defines a pouring orifice 44. A portion of the annular edge 43 projects radially, transverse to the axis X-X to form the pouring lip 45. Therefore, the pouring lip 45 extends angularly over a circumferential portion of the annular edge 43. Preferably, the pouring lip 45 extends angularly between 120° and 180°, in this example 160°.

The pouring lip 45 has a middle region 45*a* between the two ends 45*b*, 45*c*. According to one embodiment, the middle region 45*a* of the lip 45 is located opposite to the passage conduit 33 with respect to the longitudinal axis X-X of the pourer 10, advantageously aligned with a line that passes through the axis X-X and the axis X'-X' of the passage conduit 33. Thus, during pouring, if the pouring spout 40 is used with the pouring rim substantially below the rest of the pouring edge 43, the passage conduit 33 effectively operates to allow air passage as the lower opening 33*a* is not obstructed by the liquid that flows out of the container 1.

According to one embodiment, one of the liquid passage openings 31 and the middle region 45*a* of the pouring lip 45 have the same angular orientation.

Therefore, this liquid passage opening 31 is formed opposite to the passage conduit 33 with respect to the longitudinal axis X-X. Advantageously, the central portion of one of the liquid passage openings 31 is advantageously aligned with a line that intersects the axis X-X of the tubular body 20 and the axis X'-X' of the passage conduit 33, perpendicular to such axes X-X and X'-X'.

Depending on the number and angular extension of the remaining liquid passage openings 31, the pourer 10 can have an effective pouring operation even when the user holds the container with the pouring rim 45 in a wrong position, during pouring. Particularly, the pouring rim 45 may be angularly spaced from its optimal position, i.e. with the middle region 45*a* facing the area where the liquid is designed to be poured. Nevertheless, the presence of multiple liquid passage openings 31 ensures a proper pouring operation as long as the liquid that flows out of the container intercepts at least one of them.

The tubular body 20 and the pouring spout 40 are coupled together by coupling means 46 that are able to guide the movement of the pouring spout 40 relative to the tubular body 20 between the retracted and extracted positions and prevent rotation of the pouring spout 40 relative to the tubular body 20 to hold the relative angular position of the pouring rim 45 with respect to the tubular body 20 and hence, for instance, the relative position of the pouring lip 45 with respect to the passage conduit 33.

It shall be noted that any angular rotation tolerance of the pouring lip 45 relative to the tubular body 20, as required in the process of mounting and assembling the pourer 10 are deemed to fall within the definition of maintenance of the relative angular position of the pouring lip 45 with respect to the tubular body 20.

According to one embodiment, the coupling means 46 comprise at least one first guide element 47 formed inside on the tubular body 20 and at least one second guide element 48 formed outside on the pouring spout 40 and operatively coupled to the first guide element 47 to allow the pouring spout 40 to slide relative to the tubular body 20.

It shall be noted that the coupling means 46 are distinct from the liquid passage openings 31. This particularly allows positioning of the passage openings 31 and selection of their dimensional characteristics irrespective of any dimensional requirements of the coupling means 46, thereby optimizing liquid flow from within the container 1 to the pouring spout 40.

According to one embodiment, the at least one first guide element 47 comprises a plurality of angularly spaced longitudinal ribs, here three ribs, formed in the tubular body 30, here on the inner surface of the inner sleeve 26, and the at least one second guide element 48 comprises a corresponding plurality of angularly spaced recesses 48, here three recesses, formed outside the pouring spout 40, i.e. on the outer surface of the pouring spout 40, each rib 47 being engaged in a corresponding recess 48 to guide the longitudinal movement of the pouring spout 40 between the retracted and extracted positions and to prevent rotation of the pouring spout 40 relative to the tubular body 20.

Particularly, the recesses 48 are formed in an annular flange 49 which is placed at the bottom end 41 of the pouring spout 40 and projects from the pouring spout 40 perpendicular to the longitudinal direction X-X.

According to one embodiment, the pourer 10 comprises first stop means 50 for stopping the pouring spout 40 in the extracted position. Here, the first stop means 50 comprise an annular rib 51 formed in the upper portion 22 of the tubular body 20, here in the upper portion 26*b* of the inner sleeve 26 against which the annular flange 49 is designed to abut for stopping the movement of the pouring spout 40 from the retracted position to the extracted position.

In order to stably but reversibly locking the pouring spout 40 in the extracted position, the pouring spout 40 has a tapered part 41*b* whose diameter increases toward the lower portion 41 such that, when the annular flange 49 abuts against the annular rib 48, a part 41*a* of the lower portion 41 of the pouring spout 40 engages the annular rib 51 by an interference fit. Alternatively, lock means may be provided, or the first stop means 50 may be configured to stop and reversibly lock the pouring spout 40 in the extracted position.

Second stop means 52 are provided to stop the pouring spout 40 in the retracted position. According to the embodiment of the figures, the second stop means 52 consist of the wall 30 against which the lower portion 41 of the pouring spout 40, particularly the flange 49, abuts, during the movement from the extracted position to the retracted position.

From the retracted position, the pouring spout 40 may be extracted from the tubular body 20 by directly acting upon the pouring spout 40, e.g. manually, or by the action of spring members arranged between the wall 30 and the flange 49, or as shown, by providing coupling means 60 carried by the cap 100. In this embodiment, the cap 100 has a sleeve 61 with coupling means 62 for engaging corresponding coupling elements 62 carried by the pouring spout 40. In this example, the coupling elements 62 comprise an annular lip which is designed to engage an annular rib 62 formed on the inner surface of the pouring spout 40. When the pourer 10 is closed by the cap 100, the pouring spout 40 is in the retracted position and the annular lip 62 is below the annular rib 63.

As the container 1 is opened, here by unscrewing the cap 100, the action of removing the cap 100 from the pourer 10 causes the annular lip 62 to engage the annular rib 63. Thus, the longitudinal movement of the cap 100 causes a corresponding longitudinal movement of the pouring spout 40 until the annular lip 62 acts upon the annular rib 63. As soon as the pouring spout 40 reaches the extracted position, a further longitudinal movement of the cap 100 causes disengagement of the annular lip 62 from the annular rib 63 and the cap 100 may be removed from the pourer 10.

When the cap 100 is fitted to the pourer 10 again to close the container 1, the annular lip 62 acts upon the top of the annular rib 63 to move the pouring spout 40 back to the retracted position. Particularly, the position of the annular lip 62 and the annular rib 63 are selected to allow the pouring spout 40 to be stopped in the retracted position before full closure of the pourer 10 by the cap 100. Thus, once the cap 100 has fully closed the pourer 10, a further longitudinal movement of the cap 100 is allowed, such that the annular lip 62 is allowed to overreach the annular rib 63 of the pouring spout 40.

In the example of the figures, the cap 100 comprises an undercap 102 from which the sleeve 61 with the coupling elements 62 projects downwards. The undercap 102 has a capsule 103 having threads 100*a* mounted thereto, with an upper portion 103*a* attached to the undercap 102 and a lower portion 103*b* attached to the neck 2 of the container 1. Bridges 104 connect the lower portion 103*b* to the upper portion 103*a* and are designed to break upon first opening of the container 1. The capsule 103 is fitted to the container 1 by a rolling process, that is known per se and will not be further described herein.

It will be appreciated that the pourer of the present invention fulfills the intended purposes.

Those skilled in the art will obviously appreciate that a number of changes and variants may be made to the arrangements as described hereinbefore to meet incidental and specific needs.

For example, unless otherwise imposed by evident technical limitations, any feature described in a preferred embodiment may be clearly used in another embodiment, with appropriate adaptations.

Likewise, the continuity of the pourer components may be broken in any manner, provided that no functional alteration to the relevant component is caused thereby.

Also, slight tapers may be imparted to the portions described above as having an annular, cylindrical shape, in response to technological requirements.

All the changes will fall within the scope of the invention, as defined in the following claims.

The invention claimed is:

1. A pourer for a liquid container said pourer having a longitudinal axis extending along a longitudinal direction, said pourer comprising:

a tubular body able to be attached to a container, said tubular body extending longitudinally between a lower portion and an upper portion, a pouring spout housed within the tubular body and movable to reversibly slide, relative to the tubular body, in the longitudinal direction, between a retracted position, in which the pourer is designed to be closed by a cap and an extracted position, in which the pourer is designed to pour the liquid contained in the container through the pouring spout, wherein said tubular body comprises, at the lower portion:

a wall extending on a plane substantially perpendicular to the longitudinal direction to intercept the flow of liquid from the container to the upper portion of the tubular body, and at least one liquid passage opening formed laterally in the tubular body, above the wall, to allow the flow of liquid to the upper portion of the tubular body, said pouring spout has a pouring rim, which is shaped to define a pouring orientation, said tubular body comprising a circumferentially continuous inner sleeve, an outer sleeve and a connecting flange for connecting the inner and outer sleeves, the outer sleeve completely encircling the inner sleeve, said tubular body and said pouring spout are coupled together by at least one first guide element and at least one second guide element structured and arranged to guide the movement of the pouring spout relative to the tubular body between the retracted and extracted positions and prevent rotation of the pouring spout relative to the tubular body to hold the relative angular position of the pouring rim with respect to said at least one liquid passage opening, said at least one first guide element being formed inside on an inner surface of the circumferentially continuous inner sleeve of the tubular body and said at least one second guide element being formed outside on the pouring spout and operatively coupled to the at least one first guide element to allow the pouring spout to slide relative to the tubular body, said inner sleeve extends between a lower portion and an upper portion, said wall is located at the lower portion of the inner sleeve to close the bottom of said inner sleeve, and said at least one liquid passage opening is formed in the lower portion of the inner sleeve.

2. A pourer as claimed in claim 1, wherein said at least one first guide element comprises a plurality of longitudinal ribs, which are angularly spaced and formed inside on the tubular body and said at least one second guide element comprises a corresponding plurality of recesses, which are angularly spaced and formed outside on the pouring spout, each rib being engaged in a corresponding recess to guide the longitudinal movement of the pouring spout between the retracted and extracted positions and to prevent rotation of the pouring spout relative to the tubular body.

3. A pourer as claimed in claim 2, wherein said recesses are formed in an annular flange which is placed at the bottom end of the pouring spout and projects from the pouring spout perpendicular to the longitudinal direction.

4. A pourer as claimed in claim 1, wherein said at least one liquid passage opening is distinct from the at least one second guide element, said at least one second guide element comprising at least one wall portion directly facing said at least one first guide element and arranged to prevent the passage of liquid through said at least one second guide element.

5. A pourer as claimed in claim 1, wherein said at least one liquid passage opening is directly adjacent to the wall.

6. A pourer as claimed in claim 1, wherein said at least one liquid passage opening comprises a plurality of liquid passage openings in angularly spaced arrangement.

7. A pourer as claimed in claim 1, wherein said pouring rim extends angularly between two ends along a circumferential portion of the pouring spout, and has a middle region between said two ends.

8. A pourer as claimed in claim 7, wherein a liquid passage opening and said middle region of the pouring rim have the same angular orientation.

9. A pourer as claimed in claim 7, wherein said middle region of the pouring rim is located opposite to said passage conduit with respect to the longitudinal axis of the pourer.

10. A pourer as claimed in claim 1, wherein said tubular body has a passage conduit for allowing fluid communication between the interior and the exterior of the container, to form a passageway for air from the exterior to the interior of the container during pouring.

11. A pourer as claimed in claim 10, wherein said passage conduit extends longitudinally, with the longitudinal axis parallel to the longitudinal axis of the pourer, between one lower opening and one upper opening.

12. A pourer as claimed in claim 11, wherein the lower opening of the passage conduit is located level with the lower portion of the tubular body.

13. A pourer as claimed in claim 1, wherein said pouring spout has, at an upper portion thereof, an annular edge defining a pouring orifice, a portion of the annular edge projecting radially, transverse to the longitudinal axis to form a pouring lip.

14. A pourer for a liquid container said pourer having a longitudinal axis extending along a longitudinal direction, said pourer comprising:

a tubular body able to be attached to a container, said tubular body extending longitudinally between a lower portion and an upper portion, a pouring spout housed within the tubular body and movable to reversibly slide, relative to the tubular body, in the longitudinal direction, between a retracted position, in which the pourer is designed to be closed by a cap and an extracted position, in which the pourer is designed to pour the liquid contained in the container through the pouring spout, wherein said tubular body comprises, at the lower portion:

a wall extending on a plane substantially perpendicular to the longitudinal direction to intercept the flow of liquid from the container to the upper portion of the tubular body, and at least one liquid passage opening formed laterally in the tubular body, above the wall, to allow the flow of liquid to the upper portion of the tubular body, said pouring spout has a pouring rim, which is shaped to define a pouring orientation, said pourer comprises coupling means configured to couple together said tubular body and said pouring spout, said coupling means comprising:

at least one longitudinal rib formed inside on the tubular body, and at least one closed recess formed outside on the pouring spout, each rib being engaged in a corresponding recess and configured to guide the longitudinal movement of the pouring spout between the retracted and extracted positions, to prevent rotation of the pouring spout relative to the tubular body and to hold the relative angular position of the pouring rim with respect to said at least one liquid passage opening;

said tubular body comprises an inner sleeve, an outer sleeve and a connecting flange for connecting the inner and outer sleeves, the outer sleeve completely encircling the inner sleeve, said inner sleeve extends between a lower portion and an upper portion, said wall is located at the lower portion of the inner sleeve to close the bottom of said inner sleeve, and said at least one liquid passage opening is formed in the lower portion of the inner sleeve.

15. A pourer as claimed in claim 1, wherein said at least one first guide element comprises a longitudinal rib formed on the inner surface of the inner sleeve extending radially inward therefrom.

* * * * *